US005866841A

United States Patent [19]

Green et al.

[11] Patent Number: 5,866,841

[45] Date of Patent: Feb. 2, 1999

[54] FRAGMENTATION GRENADE

[75] Inventors: Richard D. Green; David W. Leeming, both of Wiltshire, United Kingdom

[73] Assignee: Royal Ordnance PLC, Lancashire, United Kingdom

[21] Appl. No.: 801,605

[22] Filed: Feb. 18, 1997

[30] Foreign Application Priority Data

Jun. 16, 1995 [GB] United Kingdom ..... 9512231

[51] Int. Cl.[6] ..... F42B 27/08

[52] U.S. Cl. ..... 102/486; 102/487; 102/495

[58] Field of Search ..... 102/482, 486, 102/487, 483, 494, 495

[56] References Cited

U.S. PATENT DOCUMENTS

| | | | |
|---|---|---|---|
| 3,447,463 | 6/1969 | Lavine | 102/492 |
| 3,448,688 | 6/1969 | Sindermann | 102/482 |
| 3,762,330 | 10/1973 | Hall | 102/487 |
| 4,178,851 | 12/1979 | Brady | 102/393 |
| 4,303,015 | 12/1981 | Bourlet | 102/492 |
| 4,328,755 | 5/1982 | Frost | 102/487 |
| 4,644,867 | 2/1987 | Hellnev et al. | 102/495 |
| 4,934,274 | 6/1990 | Mathey | 102/401 |

FOREIGN PATENT DOCUMENTS

| | | | |
|---|---|---|---|
| 859922 | 1/1941 | France | 102/482 |
| 1 381 702 | 1/1975 | United Kingdom . | |
| 2 101 280 | 1/1983 | United Kingdom . | |

*Primary Examiner*—Stephen M. Johnson
*Attorney, Agent, or Firm*—Nixon & Vanderhye, P.C.

[57] ABSTRACT

A fragmentation grenade comprises a quantity of high explosive (11) contained within a casing (12, 13) and means (29) for detonating the high explosive (11) so as to cause the casing (12, 13) to disintegrate into a plurality of high velocity fragments (13). The high explosive (11) and the casing (12, 13) are so configured that the fragments (13) are preferentially projected in one or more particular directions relative to the axis (X—X) of the casing (12, 13), and the grenade is provided with a self-righting mechanism (22), whereby the axis can automatically be placed in a desired orientation.

13 Claims, 3 Drawing Sheets

FRAGMENTATION GRENADE

BACKGROUND OF THE INVENTION

1. Field of the Invention

This invention relates to fragmentation grenades, that is to say, to munitions of the type comprising a frangible casing which contains a quantity of high explosive, such that upon detonation of the high explosive, the casing disintegrates into a number of individual high-velocity fragments. The fragments in the casing, prior to detonation, can be preformed discrete fragments or pellets which may be held together by a suitable matrix material; or the casing can be notched so as to define the shape and size of the fragments generated upon detonation (for example formed from prenotched wire, or cast with grooves or notches in its surface); or the casing may be un-notched, so that the generated fragments are more random in terms of their size and shape.

2. Discussion of Prior Art

The conventional grenade has been in universal use as an anti-personnel weapon for many years, but the basic concept as outlined above has remained essentially unchanged. The present invention seeks to provide a means to improve considerably the performance of the fragmentation grenade, ie to increase substantially the probability of incapacitating a human target for a given mass.

SUMMARY OF THE INVENTION

According to the present invention there is provided a fragmentation grenade comprising a quantity of high explosive contained within a casing having an axis, and means for detonating the high explosive so as to cause the casing to disintegrate into a plurality of high velocity fragments, characterised in that the high explosive and the casing are so configured that the fragments are preferentially projected in one or more particular directions relative to the axis of the casing, and the grenade is provided with a self-righting mechanism, whereby the axis can automatically be placed in a desired orientation. Preferably the configuration is such that a majority of the fragments are projected in directions between normal to the said axis and 10° to the normal, advantageously between 1° and 6° to the normal.

Advantageously the casing is substantially in the form of a truncated cone. The truncated cone preferably has an inclusive cone angle between 3° and 20°, most preferably between 5° and 12°.

Preferably the high explosive is in direct contact with the inner surface of the casing so that the shock generated on detonation of the explosive is coupled directly into the casing. In a preferred embodiment, the casing comprises a plurality of preformed individual fragments.

The fragments may be mounted on a suitable liner forming the inner surface of the casing so as to contain the high explosive.

Alternatively the fragments may be embedded in a matrix material forming a composite which defines the casing.

A very suitable material for the fragments is tungsten, or a tungsten rich alloy.

The fragments may advantageously be in the form of spheres.

BRIEF DESCRIPTION OF THE DRAWINGS

The invention will now be described by way of example only, with reference to the accompanying drawings, in which.

DETAILED DISCUSSION OF PREFERRED EMBODIMENTS

Figure 1:
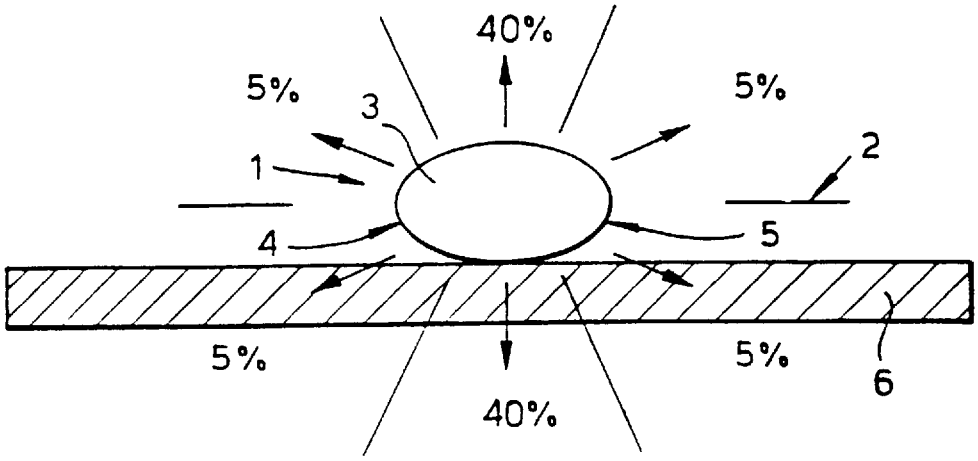
Fig.1. (PRIOR ART)
FIG. 1 shows a known hand grenade of conventional form, and illustrates diagrammatically the mass distribution of fragments generated on detonation thereof.
Figure 2:
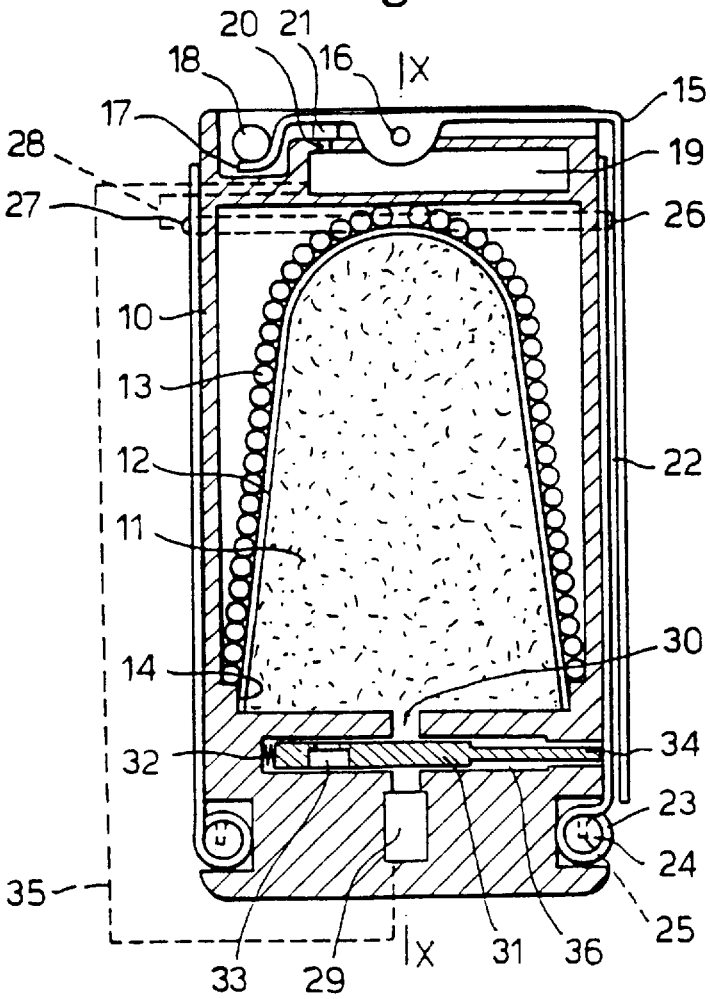
FIG. 2 shows, in section, a hand grenade in accordance with the invention, in the unarmed condition.
Figure 3:
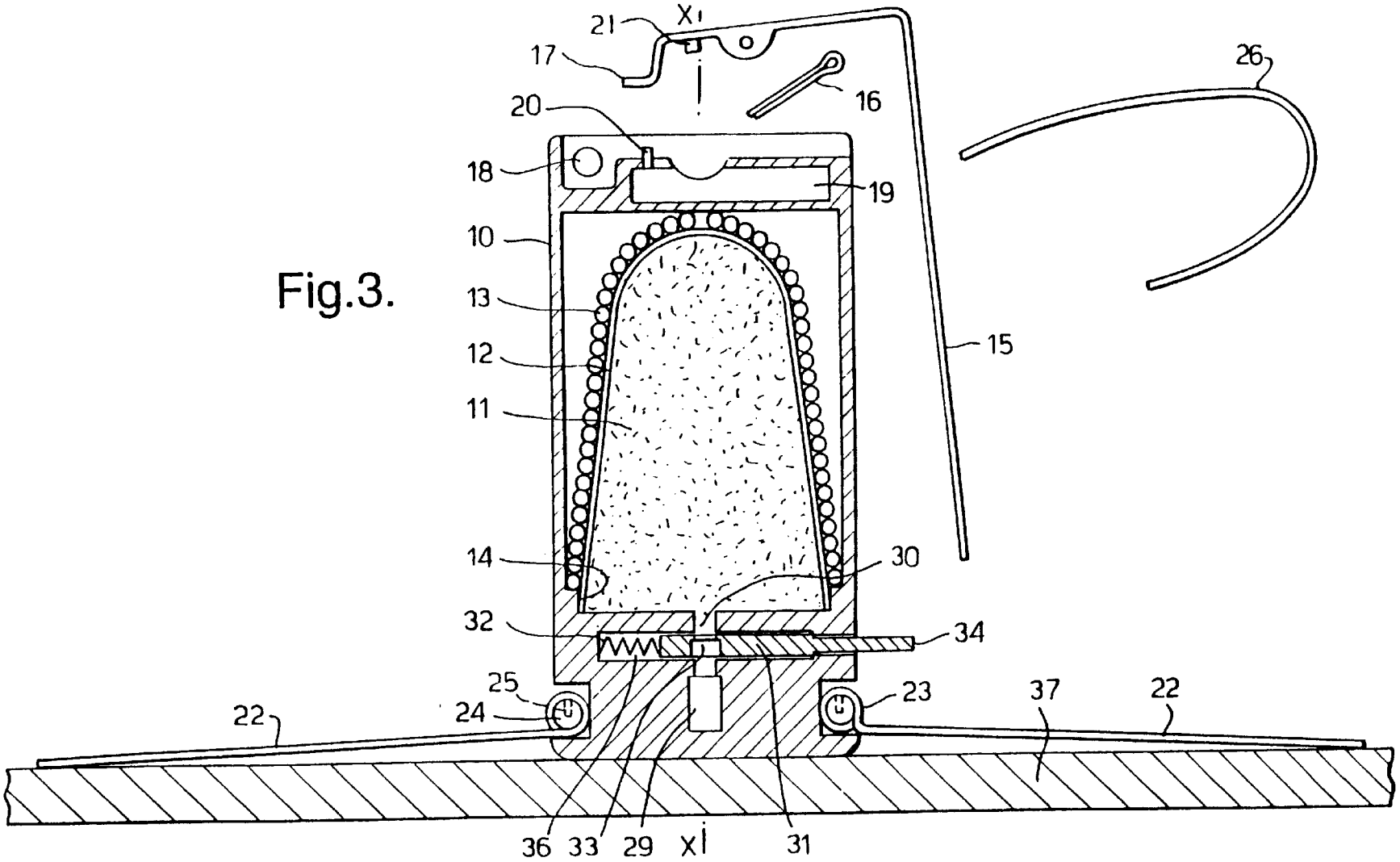
FIG. 3 shows, in section, the novel grenade of FIG. 2 in the armed condition, after having been thrown and just prior to detonation.

As shown in FIG. 1, a conventional grenade 1 is of substantially ovoid form with a longitudinal axis 2, and a cast prenotched body 3 containing high explosive (not shown). The grenade 1 has a base 4 at one end, and at the axially opposite end 5 has a fuze (not shown). The grenade lays on a substrate 6, representing the ground, and after throwing will most probably come to rest in the orientation shown, by virtue of its geometry. Such a grenade will typically generate a fragment pattern on detonation, having the mass distribution indicated by the percentage figures noted in FIG. 1. It can thus be seen that about half of the fragments are directed into the ground where their effect is wasted. A large proportion is also wasted by being directed high into the air, and very few fragments are directed to left or right. Comparatively few fragments are effectively directed at man-height, and only in the two 40° sectors substantially normal to the plane of the Figure (ie towards and away from the reader). As shown in FIGS. 2 and 3, the novel grenade in accordance with the invention comprises a light, moulded cylindrical plastics body 10, containing a quantity of high explosive 11. The high explosive 11 is cast into a casing comprising a thin aluminium liner 12 and plurality of preformed fragments 13 in the form of tungsten spheres, which cover the outer surface of the liner 12, to which they are adhesively secured. The casing 12, 13 is of frusto-conical shape with an inclusive cone angle of 8° and a domed upper end, and has an axis is of symmetry X—X. The explosive/casing assembly is tightly seated in a recess 14 in the base of the body 10. The grenade is provided with a fly-off lever 15 which is normally held in place by a safety pin 16. The end 17 of the lever 15 is held captive under a detent 18. In the position shown in FIG. 2, the end 17 is resiliently stressed in a sense such as to tend to move the remainder of the lever 15 away from the body 10, around the detent 18 as a pivot. The presence of the pin 16 prevents this movement.

Within the upper part of the body 10, below the pin 16, there is provided an electric timer and delay mechanism 19, actuable by closure of a sprung micro-switch 20 which is normally held open by a protuberance 21 on the lever 15.

The grenade is provided with a self-righting mechanism comprising a plurality of pre-loaded spring legs 22 distributed evenly around the base of the body 10. The lower end of each leg 22 (as shown in FIG. 2 ) is wound into a torsional spring 23 which in each case is located around a boss 24. The free end 25 of each spring 23 is located in a recess in the boss, so that it cannot move when the leg 22 is rotated about the boss. The legs are assembled so that in the unstressed state of the springs 23, the legs will lie somewhat below the horizontal when the grenade is upright with the axis X—X vertical, as shown in FIG. 3. The legs are then moved to their upright positions illustrated in FIG. 2, ic so as to lie alongside the body 10, and arc held in this position by a plastics band 26 which is provided with an explosive cutting device 27, controlled from the delay mechanism 19 via a pyrotechnic delays cord 28. Delay cord 28 is illustrated diagrammatically in FIG. 2 only; it would in practice not extend to a significant extent outside the body 10. The grenade is also provided with a detonator 29 located in the base of the body 10, which can be initiated so as to direct flash through a passage 30 in the body, into the base of the explosive 11 which is thus detonated.

The passage 30, as illustrated in FIG. 2, is interrupted by a safety and arming device in the form of a delayed arming shutter 31, slideable transversely in a bore 36 within the body 10 under the influence of a pre-stressed compression spring 32.

The shutter 31 has a passage 33 therethrough, which can be brought into alignment with the detonator 29 and passage 30 under the action of the spring 32. This movement is prevented in the condition illustrated in FIG. 2, by the presence of one of the legs 22, against which the outer end 34 of the shutter 31 bears. In an alternative arrangement, the detonator could itself be carried in a recess in the shutter, at the location of the passage 33.

The detonator 29 can be initiated by means of a pyrotechnic delay cord 35 illustrated diagrammatically only in FIG. 2. In practice the cord 35 would preferably be located inside the body 10. The delay cord can be initiated from the delay mechanism 19. The grenade operates in the following sequence.

The safety pin 16 is twisted and withdrawn by the user, thus removing the first safety device. The lever 15 is held in place for so long as the user continues to grip the lever against the body 10.

Upon throwing the grenade, the lever 15 is released. It first rotates about the pivot 18 under the actual of its resiliently stressed end 17, and then escapes from the body 10 as shown in FIG. 3. The switch 20 is thus released, and the timer mechanism, 19 initiates the cord 28, and hence the cutter 27, so that the band 26 is broken, thus releasing the legs 22—after a suitable delay (say 3.5 seconds) from release of the switch 20, sufficient to allow the grenade to have come to rest on the ground 37 (FIG. 3). The legs 22 therefore deploy into the positions show in FIG. 3, and the grenade is thus automatically erected so that its axis X—X is vertically oriented.

Release of the legs 22 permits the shutter 31 to slide transversely in its bore 36, thus providing open access from the detonator 29 through passages 30 and 33, to the explosive 11. The passage 33 may contain a secondary explosive material, forming part of the explosive chain from detonator 29 to explosive 11.

The detonator 29 is initiated via the pyrotechnic delay 35 so as to detonate the explosive 11 after a further suitable delay—say 0.5 seconds after initiation of the cutter 27.

The resultant force of explosion is transferred via the aluminium liner 12 to the preformed fragments of tungsten or tungsten alloy, which are in the form of spheres 13 or other desired shapes.

Figure 4:
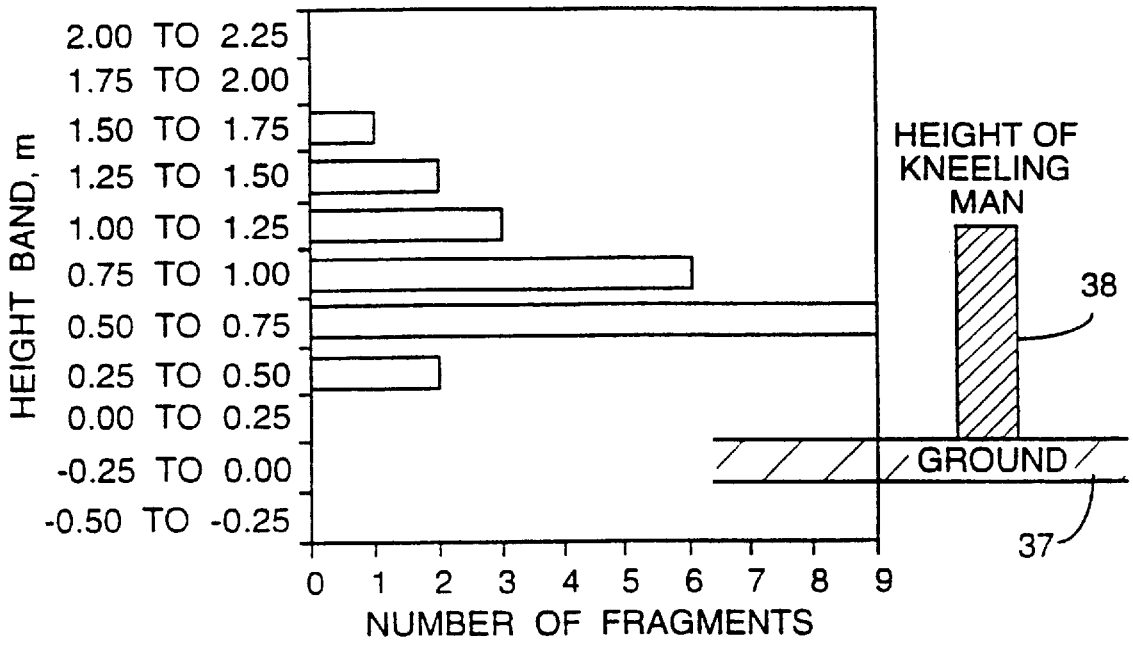
FIG. 4 shows, diagrammatically, the mass distribution of fragments generated on detonation of the grenade shown in FIGS. 2 and 3.

FIG. 4 is a bar chart illustrating the fragment distribution achieved with the grenade of FIGS. 2 and 3, showing numbers of fragments projected into various height bands (expressed in meters) measured with respect to the level of the ground, 38 at a range of 5 meters. A bar 38 illustrates the height of a target in the form of a kneeling man at this range. It will be seen that no fragments passed towards the ground, nor above a height of 1.75 meters. The majority of fragments would strike the target above 0.5 meters but below 1.25 meters—ie from waist to head height. This is considered optimum, ie for a given mass of grenade, the performance against the described target is highly efficient in terms of fragments (and their individual mass) striking the target. The performance is very considerably improved as compared to the conventional grenade 1 as illustrated in FIG. 1.

Because the fragments generated by the grenade according to the invention are rising, albeit at a relatively low angle, they can be expected to pass safely over the head of a user located at, say 20 meters distance.

In FIGS. 2 and 3, tungsten spheres are used as preformed fragments 13 of appropriate size which, owing to their high density, have the capability to penetrate body armour at operational ranges. Alternatively, lighter materials could be used which for the same total mass would allow more fragments to be used and consequently achieve a greater number of hits on the target. These lighter fragments would not perforate body armour but their accumulated effort on unprotected parts of the human body would have an enhanced incapacitating effect.

The fragments 13 may be of other preformed shape, or formed by the fragmentation of wire or a solid body, with or without the influence of notching or embossing to control fragment size, and with or without a liner.

The geometry of the warhead provides optimum distribution of fragments against targets within the required range of effect. The novel design of hand grenade shown in FIGS. 2 and 3 is configured to produce a band of fragments which achieves the maximum number of hits to a kneeling man at 5 meters. Should the user specify a different target size and range of effect requirement, this can be accommodated by changing the angled profile of the warhead. The warhead geometry includes fragments in the upper sections to attack targets centred above the main region of fragment trajectories.

By virtue of their rising trajectories the fragments pass overhead of personnel beyond the intended range of effect, which in the application of the invention to a hand grenade provides operational safety for the grenade thrower. The fragments fall to ground at greater range with a safe diminished velocity.

Grenades is accordance with the invention can be hand thrown. The invention is also applicable to rifle grenades, projected grenades, or grenades designed for use in a grenade launcher, grenade machine gun, or multi-barrel discharger.

It will also be appreciated that where pyrotechnic delays have been used (eg cords 28 and 35), electrical delays may be substituted therefor; and similarly for electrical switch 20 and the electric delay mechanism 19, pyrotechnic devices may be substituted. Other possible modifications and variations will be readily apparent to those skilled in the art, and these are also to be considered as within the scope of the invention.

With this invention wasted fragments are eliminated (as compared to the conventional grenade) and the ineffective fragment distribution is replaced by a more even distribution of fragments over the areas subtended by target personnel in the vicinity of the grenade. This concentration of fragments in the target region gives an increase in the number of hits, or allows the use of heavier fragments within the grenade weight limitation. By these means the effectiveness of the grenade is substantially increased, and the efficient use of fragmentation mass warrants the use of tungsten or other high density material capable of defeating body armour.

We claim:

1. A fragmentation grenade comprising:

a quantity of high explosive contained within a casing having an axis;

a detonator for detonating the high explosive so as to cause the casing to disintegrate into a plurality of high velocity fragments, wherein the high explosive and the casing are so configured that the fragments are preferentially projected in one or more particular directions relative to the axis of the casing; and a self-righting mechanism, whereby the axis can automatically be placed in a desired orientation prior to detonation, wherein the configuration is of the explosive and the casing is such that a majority of the fragments are projected in directions between normal to the said axis and 10° to the normal.

2. A fragmentation grenade according to claim 1 wherein said directions are between 1° and 6° to the normal.

3. A fragmentation grenade according to claim 1 wherein the casing is substantially in the form of a truncated cone.

4. A fragmentation grenade according to claim 1 wherein the casing is substantially in the form of a truncated cone having an inclusive cone angle between 3° and 20°.

5. A fragmentation grenade according to claim 4 wherein the cone angle is between 5° and 12°.

6. A fragmentation grenade according to claim 1 wherein the casing comprises a plurality of preformed individual fragments.

7. A fragmentation grenade according to claim 6 wherein the fragments are mounted on a suitable liner forming the inner surface of the casing so as to contain the high explosive.

8. A fragmentation grenade according to claim 6 wherein the fragments are in the form of spheres.

9. A fragmentation grenade according to claim 1 wherein the material of the fragments is tungsten, or a tungsten rich alloy.

10. A fragmentation grenade comprising:

a quantity of high explosive contained within a casing having an axis;

means for detonating the high explosive so as to cause the casing to disintegrate into a plurality of high velocity fragments, wherein the high explosive and the casing are so configured that the fragments are preferentially projected in one or more particular directions relative to the axis of the casing; and a self-righting mechanism, whereby the axis can automatically be placed in a desired orientation prior to detonation wherein the casing is substantially in the form of a truncated cone.

11. A fragmentation grenade comprising:

a quantity of high explosive contained within a casing having an axis;

a detonator for detonating the high explosive so as to cause the casing to disintegrate into a plurality of high velocity fragments, wherein the high explosive and the casing are so configured that the fragments are preferentially projected in one or more particular directions relative to the axis of the casing; and a self-righting mechanism, whereby the axis can automatically be placed in a desired orientation prior to detonation, wherein the casing is substantially in the form of a truncated cone, wherein the truncated cone has an inclusive cone angle between 3° and 20°.

12. A fragmentation grenade according to claim 11 wherein the cone angle is between 5° and 12°.

13. A fragmentation hand grenade thrown above the ground by an operator, said grenade comprising:

a quantity of high explosive contained within a casing having an axis;

a detonator for detonating the high explosive so as to cause the casing to disintegrate into a plurality of high velocity fragments, wherein the high explosive and the casing are so configured that in use the fragments are preferentially projected in one or more particular directions relative to the axis of the casing; and a self-righting mechanism which is operable after the grenade is thrown and prior to detonation, whereby the axis can automatically be placed in a desired orientation relative to the ground.

* * * * *